US006318575B1

(12) United States Patent
Lillelund et al.

(10) Patent No.: US 6,318,575 B1
(45) **Date of Patent: *Nov. 20, 2001**

(54) NESTING INSULATED EGG SERVER

(75) Inventors: Stig Lillelund, Gentofte; Jakob Heiberg, Charlottenlund, both of (DK)

(73) Assignee: Dart Industries Inc., Orlando, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/159,918

(22) Filed: Sep. 24, 1998

(51) Int. Cl.[7] ..... B65D 21/00

(52) U.S. Cl. ..... 220/4.24; 206/505; 206/519; 206/520; 211/14; 220/4.26

(58) Field of Search ..... 211/14; 206/505, 206/520, 519, 515, 508; 220/4.24, 4.26, 508

(56) References Cited

U.S. PATENT DOCUMENTS

| | | | | |
|---|---|---|---|---|
| 187,186 | * | 2/1877 | Smith | 211/14 |
| D. 252,312 | * | 7/1979 | Ackeret | D7/503 |
| D. 417,818 | * | 12/1999 | Lillelund et al. | D7/503 |
| 1,759,398 | * | 5/1930 | Hart | 211/14 |
| 1,829,664 | * | 10/1931 | McKay | 211/14 X |
| 2,054,934 | * | 9/1936 | Grafenberger | 211/14 X |
| 2,429,958 | * | 10/1947 | Liebmann | 206/505 |
| 2,531,955 | * | 11/1950 | Toney | 211/14 X |
| 2,617,280 | * | 11/1952 | Anderson | 211/14 X |
| 2,665,571 | * | 1/1954 | Lochead | 211/14 X |
| 2,899,097 | * | 8/1959 | Haskins | 220/4.24 |
| 3,032,228 | * | 5/1962 | Andrews | 220/4.24 |
| 3,079,027 | * | 2/1963 | Edwards | 206/519 |
| 3,091,361 | * | 5/1963 | Gawron | 206/508 |
| 3,325,048 | * | 6/1967 | Edwards | 206/520 |
| 3,713,528 | * | 1/1973 | Daenen et al. | 211/14 X |
| 3,932,113 | | 1/1976 | Thrush . | |

FOREIGN PATENT DOCUMENTS

| | | | | |
|---|---|---|---|---|
| 1253068 | * | 12/1960 | (FR) | 220/4.24 |
| 2246458 | * | 5/1975 | (FR) | 220/4.24 |

OTHER PUBLICATIONS

Egg Cup KK02, S. Giovannoni et al., Girontondo, Milan, Italy.

* cited by examiner

*Primary Examiner*—Stephen P. Garbe
*Assistant Examiner*—Joseph C. Merek
(74) *Attorney, Agent, or Firm*—Taylor J. Ross

(57) ABSTRACT

An egg server for cooked eggsin the shell. The server includes a bottom wall from which a sidewall extends, to form an interior which partially receives an egg. An inclined support face is formed within the interior to accommodate a wide variety of egg sizes, increasing the usefulness of the server. The lower outer face of the server may be of reduced size to nest within the interior of another of the egg servers, permitting multiple egg servers to be placed in a stacked position for storage. An upper rim of the sidewall may have a shape which mates with itself in an inverted position, permitting the upper rims of two egg servers to abut when the upper of the two egg servers rest upon the other egg server in an inverted relationship referred to as an insulating position. In this insulating position the two egg servers combine to encase an egg, retaining its heat prior to serving.

1 Claim, 1 Drawing Sheet

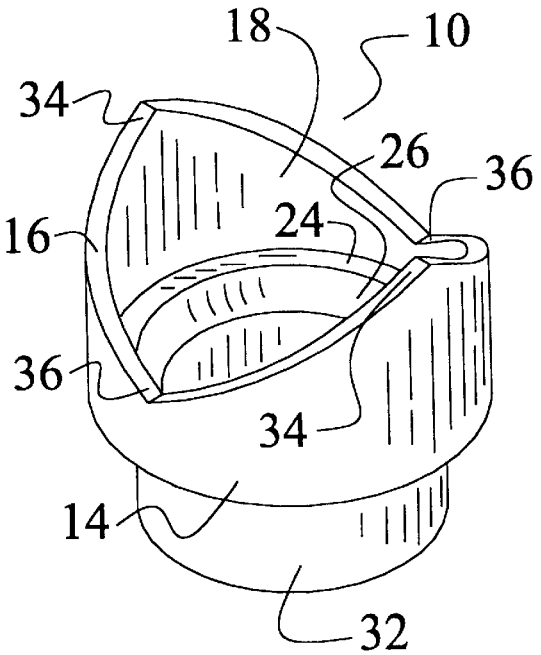
Fig. 1
Fig. 2
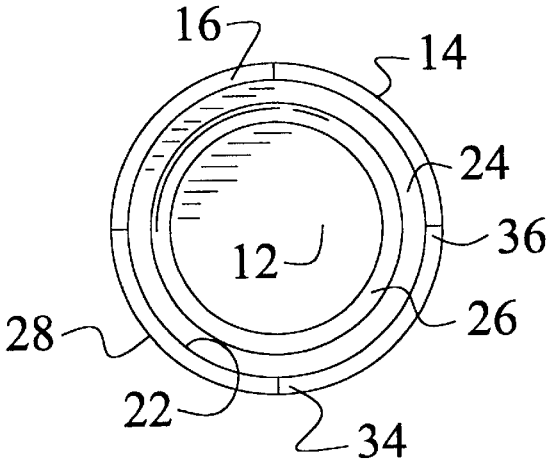
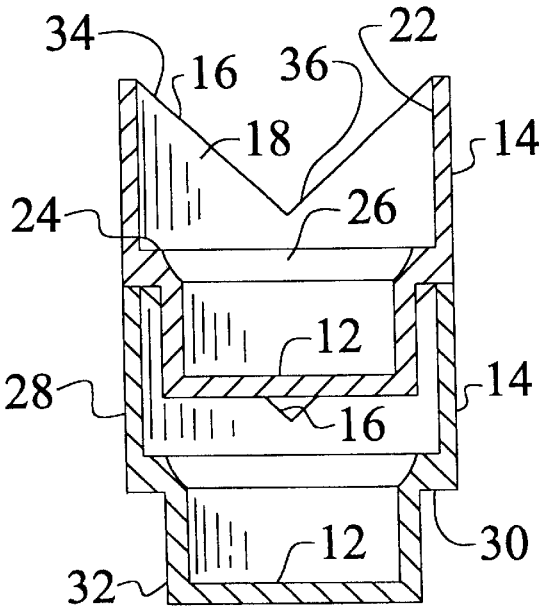
Fig. 3
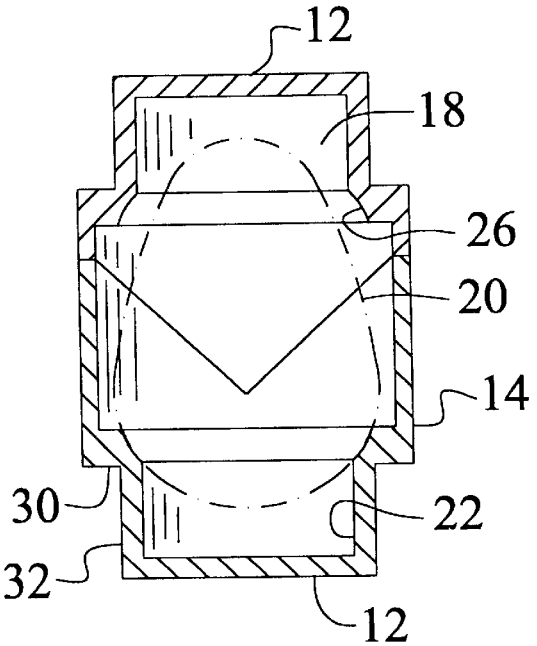
Fig. 4

NESTING INSULATED EGG SERVER

CROSS-REFERENCE TO RELATED APPLICATIONS

This application is related to Ser. No. 29/094,056 which is incorporated by reference herein and made a part hereof, including but not limited to those portions which specifically appear hereinafter.

STATEMENT REGARDING FEDERALLY SPONSORED RESEARCH

Not Applicable.

BACKGROUND OF THE INVENTION

The present invention relates in general to an egg server, commonly referred to as an egg cup. In particular, the present invention relates to an improved egg server which may be nested with identical egg servers in a vertical stacking relation ship in upright orientations for storage, and with a single identical egg server in an inverted orientation to enclose an egg for insulating and heat retention.

Egg servers, commonly referred to as egg cups, are well known and are employed for serving eggs within the shell. Such eggs are typically hard or soft boiled. These servers commonly include an upwardly concave egg retaining portion to hold the egg, and often include a base to raise the egg retaining portion and provide stability.

While such egg servers are serviceable, they have drawbacks. First, the variation in egg sizes often result in the egg not being well supported within the egg cup. Second, they are cumbersome to store, requiring an amount of space which is typically not justified by their infrequent use. Second, while they hold a cooked egg, they do not aid in keeping the egg hot prior to serving. It is therefore desirable to provide an egg server which addresses these problems.

SUMMARY OF THE INVENTION

An object of the present invention is to provide an egg server which may accommodate a wide variety of egg sizes in a stable manner.

Another object of the present invention is to provide an egg server which reduces storage space requirements for a set of such servers.

Yet another object of the present invention is to provide an egg server which permits insulation of the egg prior to serving to maintain its temperature.

These and other objects are achieved by an egg server for cooked eggs in the shell. The server includes a bottom wall from which a sidewall extends, to form an interior which partially receives an egg. An inclined support face is formed within the interior to accommodate a wide variety of egg sizes, increasing the usefulness of the server. The lower outer face of the server may be of reduced size to nest within the interior of another of the egg servers, permitting multiple egg servers to be placed in a stacked position for storage. An upper rim of the sidewall may have a shape which mates with itself in an inverted position, permitting the upper rims of two egg servers to abut when the upper of the two egg servers rest upon the other egg server in an inverted relationship referred to as an insulating position. In this insulating position the two egg servers combine to encase an egg, retaining its heat prior to serving.

BRIEF DESCRIPTION OF THE DRAWINGS

The objects and features of the invention noted above are explained in more detail with reference to the drawings, in which like reference numerals denote like elements, and in which:

FIG. 1 is a top, front perspective view of a egg server according to the present invention;

FIG. 2 is a top plan view thereof;

FIG. 3 is a cross-sectional side view of two egg servers in a stacked position; and FIG. 4 is a cross-sectional side view of two egg servers in an insulating position.

DETAILED DESCRIPTION OF THE INVENTION

With reference to FIG. 1, an egg server according to the present invention is generally designated by reference numeral 10. The egg server 10 includes a bottom wall 12 having an outer periphery. This outer periphery may be a variety of shapes, but is preferably circular. Extending upward from the outer periphery of bottom wall 12 is a sidewall 14, which terminates at an upper rim 16, spaced from the bottom wall 12. The sidewall 14 may have various cross-sectional shapes, although circular is preferred for reasons made clear below. While the bottom wall 12 and sidewall 14 could be formed of diverse materials joined together, it is preferred that they be formed as a monolithic unit. Similarly, while such a monolithic unit could be formed of various materials, such as glass, ceramic or stainless steel, it is preferred that they be formed of plastic, using an injection molding process.

The bottom wall 12 and sidewall 14 together define an interior 18 which will receive a portion of an egg 20, identified in dashed line in FIG. 4. As is common with prior art egg cups, the egg server 10 is preferably sized such that the upper rim 16 is spaced below the uppermost portion of the egg 20, providing access to the upper portion of the egg for eating. In its simplest form, the bottom of egg 20 could rest upon the bottom wall 12, and the sidewall 14 would serve to support the egg 20 against undue lateral motion by abutment of the egg 20 against an inner face 22 of sidewall 14. To provide the most support, the sidewall 14 preferably has the circular cross-section noted above, so as to match the cross-sectional shape of the egg 20. Such a circular shape is not required, however.

Given variations in sizes of eggs, it is difficult to provide a size (or preferably diameter) of sidewall 14 which will accept the largest of eggs, while still providing adequate support to the smallest of eggs. To overcome this problem, it is preferred that the inner face 22 include a support shoulder 24. The support shoulder 24 takes the form of an upward facing shoulder extending about the periphery of inner face 22, and having a support face 26 in the general form of an upward increasing taper. As such, the lower edge of support face 26 will have a smaller size (or preferably diameter) than that of the upper edge, as best shown in FIGS. 3 and 4. The taper of the support face 26 will accommodate eggs 20 of various sizes, as may be readily envisioned. If the support face 26 is formed as a section of a planar cone, this support will be line contact. While this may be acceptable, it is preferred that the support face 26 have a concave inward configuration, such as by forming the surface as a section of an ellipsoid as shown. Such a curved surface may provide increased contact for increased support.

The radially outer (and therefore upper) edge of the support face 26 may be coincident with the inner face 22 (not arrangement not being shown) such that the support face 26 forms the entirety of the support shoulder 24. However, it is preferred that the upper edge of the support face 26 be spaced radially inward of the inner face 22, as shown. This spacing permits a portion of the egg 20 above the support face 26 to extend radially outward beyond the support face 26, as illustrated in FIG. 4, allowing larger eggs to be accommodated.

The above description relates principally to the interior 18 of the egg server 10. The exterior of the egg server 10 may be of any shape desired. However, it is preferred that an outer face 28 of the sidewall 14 include a downward facing shoulder 30 formed by a reduced size (or preferably diameter) section 32 leading to the bottom wall 12. This reduced size section 32 (if employed) will have a size and shape which will allow the reduced size section 32 of one egg server 10 to be received within the interior 18 of another of the egg server 10, with the shoulder 30 of the one egg server 10 resting upon the upper rim 16 of the other of the egg server 10. This is illustrated in FIG. 3, and this is referred to as a stacked position of the egg server 10. As may be envisioned, further egg servers 10 may be placed upon the previously mentioned egg servers 10 in a similar stacked position to nest together.

With this arrangement, a plurality of the egg servers 10 of the present invention may be stored within a much smaller area, since the egg servers 10 may be stacked as far as available volume permits. This reduced storage space requirement for the egg server 10 provides clear advantages over non-stacking egg servers. This reduced storage space requirement, combined with the reduced cost available through forming the egg server 10 using injection molding of plastic, may make the egg server 10 of the present invention a feasible addition to many households which previously would have considered egg servers an unjustified luxury.

The egg server 10 of the present invention may alternatively or additionally include a further feature associated with its exterior shape. Specifically, the upper rim 16 may be formed such that it permits insulating of the egg prior to consumption, retaining heat for optimal serving temperature. This arrangement is illustrated in FIG. 4.

In particular, the upper rim 16 may be formed such that two of the egg servers 10 may be stacked in an inverted relationship with their upper rims 16 abutting. This is referred to as an insulating position. As shown, in this insulating position, the interiors 18 of the two stacked egg servers 10 are combined to encase the egg 20, reducing heat loss (especially when the egg servers 10 are formed of low relatively poor heat conducting materials such as plastic).

To provide this insulating position with upper rims 16 abutting, the upper rim 16 of each egg server 10 must have a shape which is substantially identical in both the upright position (shown by the lowermost egg server 10 in FIG. 4) and the inverted position (shown by the uppermost egg server 10 in FIG. 4). This may be achieved in many ways. For example, in the embodiment shown, the upper rim 16 includes two peripherally equidistant spaced peaks 34, separated by and defining two valleys 36. The angle forming these peaks 34 and valleys 36 is chosen such that the peaks 34, when inverted, will conform to, and fill, the valleys 36. While two such peaks 34 and valleys 36 have been shown, other numbers are possible. Similarly, while the embodiment shown employs relatively straight lines forming sharply pointed peaks 34 and valleys 36, more rounded forms may be employed.

While variations are possible as noted above, certain variations are more suited to actual use than others. Specifically, while some variations will technically permit the desired mating inverted relationship, they are not stable in this position. For example, forming the upper rim 16 by a single plane will provide an inverted mating, but will not serve to resist relative lateral movement of the two egg servers 10. To provide such a resistance to relative lateral movement, it is preferred that the upper rim 16 be more complex, and include portions which are at an angle with respect to other portions, and preferably which are mutually perpendicular. As an example, in the embodiment shown the orientation of the tips of the peaks 34 are formed perpendicular to the orientation of the roots of the valleys 36. With this arrangement, motion parallel to the roots of the valleys 36 would be resisted by the tips of the peaks 34, and vice versa. Numerous other geometric forms for the upper rim 16 may be achieved which provide this advantage, and which also permit the desired inverted mating to form the insulating position.

As such, a pair of the egg servers 10 may be placed in the insulating position to encase the egg 20, retaining its heat. This will enhance the flavor of the egg 20. This is achieved without the need for a separate cover having heat retention as its only function. Rather, the cover according to the present invention may be a separately usable egg server 10. This reduces storage requirements in the home, cost for purchasing an insulating egg server, and use of natural resources.

While implicit from the description above, it is noted that the support face 26, reduced size section 32, and mating inverted form of the upper rim 16 are not required to be used together. Rather, each may be used individually to provide an improved egg server, or may be used in any combination for increased utility.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

REFERENCE NUMERAL LIST FOR 130434-M200

| | | |
|---|---|---|
| 10 egg server | 20 egg | 30 shoulder |
| 12 bottom wall | 22 inner face | 32 reduced size section |
| 14 sidewall | 24 support shoulder | 34 peaks |
| 16 upper rim | 26 support face | 36 valleys |
| 18 interior | 28 outer face | |

What is claimed is:

1. A nesting insulated egg server, comprising:

a bottom wall having a periphery;

a sidewall extending upward from said periphery to an upper rim, said sidewall and bottom wall together defining an interior adapted to receive a portion of an egg therein, said upper rim having a configuration which permits mating with itself in an inverted position, said sidewall having an outer face having a downward facing shoulder formed by a reduced size section between said downward facing shoulder and said bottom wall, said reduced size section having a size and shape to be received within said interior of another of said egg servers with said downward facing shoulder resting upon said upper rim of said other of said egg servers, said sidewall having an inner face, a support shoulder opening upward on said inner face at a position spaced below said upper rim, said support shoulder being constructed and arranged to support an egg thereon and including an upwardly increasing taper formed from a section of an ellipsoid.

* * * * *